United States Patent [19]

Wakamatsu et al.

[11] 4,344,268

[45] Aug. 17, 1982

[54] BAG SLITTING APPARATUS

[75] Inventors: Atsuyuki Wakamatsu, Shimizu; Keisuke Tonooka, Shizuoka, both of Japan

[73] Assignee: Daiwa Can Company, Japan

[21] Appl. No.: 200,058

[22] Filed: Oct. 23, 1980

[30] Foreign Application Priority Data

Mar. 14, 1980 [JP] Japan ..... 55/33397

[51] Int. Cl.[3] ..... B65B 69/00

[52] U.S. Cl. ..... 53/384; 83/176; 83/513; 83/555; 414/412

[58] Field of Search ..... 53/384, 492, 381; 414/412; 83/175, 176, 555, 644, 924, 513

[56] References Cited

U.S. PATENT DOCUMENTS

| | | | |
|---|---|---|---|
| 1,938,787 | 12/1933 | Abbott, Jr. | 83/555 X |
| 3,641,855 | 2/1972 | Balle | 83/555 X |
| 3,732,767 | 5/1973 | Habert | 83/555 X |
| 4,158,417 | 6/1979 | Inoue | 414/412 |
| 4,253,292 | 3/1981 | Lipes | 53/384 |
| 4,285,625 | 8/1981 | Yamada | 414/412 |

*Primary Examiner*—Frank T. Yost

*Attorney, Agent, or Firm*—Daley & Brandt

[57] ABSTRACT

Apparatus for slitting an elongated bag enclosing an article. The apparatus includes a bag support and a mechanism for engaging a portion of the bag wall adjacent the middle of the bag and pulling the engaged wall portion in a direction transverse to the axis of the bag so that the engaged wall portion extends in such transverse direction away from the article enclosed in the bag. The apparatus includes a pair of blades and mechanism for forcing the blades through the wall of the bag between the engaged wall portion and the article to puncture the bag. The blade movement mechanism is arranged to move the blades in opposite directions towards the end of the bag after the blades have so punctured the bag wall to slit the wall of the bag longitudinally.

12 Claims, 8 Drawing Figures

BAG SLITTING APPARATUS

BACKGROUND OF THE INVENTION

This invention relates to an apparatus for opening an elongated bag containing an article by slitting the wall of the bag.

One well known apparatus for slitting the wall of an elongated bag is schematically illustrated in FIGS. 1 and 2. This apparatus includes a support member 9 defining a V-shaped, horizontally extensive groove 11 (FIG. 2). A cutter assembly is provided, such cutter assembly including a large number of blades 1*a* through 1*n* fixed to a pair of blade support plates 2 and 3 by bolts 4*a* through 4*n*. The cutter assembly is disposed above the support member, and the blades 1*a* through 1*n* being disposed in a row extending parallel to the axis of groove 11. As shown in FIG. 1, the cutter assembly is movably mounted to the frame of the apparatus. A link 6 is rotatably connected at one end of a fixing plate 5 by a bolt 7, fixing plate 5 in turn being fixedly connected to the frame of the apparatus (not shown). The other end of link 6 is rotatably connected to the cutter assembly by a bolt 8 at one end of the cutter assembly. A similar arrangement of link 6*a*, fixing plate 5*a* and bolts 7*a* and 8*a* is provided at the opposite end of the cutter assembly. A plurality of vertically movable grippers 10, of which only one is illustrated in FIG. 2, are provided. These grippers are disposed above the support member 9 and above the cutter assembly. The grippers are arranged in a row extending along the length of groove 11.

In operation, an elongated bag A, containing an elongated article is disposed on support member 9 so that the bag rests in the groove 11 substantially coaxially therewith. The support member is then elevated to the position indicated in broken lines in FIG. 2 so that the bag is adjacent the grippers 10. The grippers 10 are then actuated to engage the bag wall and are moved upwardly to pull the engaged portions of the bag wall upwardly away from the article enclosed in the bag and thus form a crease extending upwardly from the remainder of the bag along the entire length of the bag. The cutter assembly is then moved from the retracted position illustrated in solid lines in FIG. 1 to the extended position partially illustrated in broken lines in FIG. 1. During such movement, each of the links 6 and 6*a* swings about the associated one of the bolts 7 and 7*a* so that the cutter assembly moves in an arcuate fashion towards the medial plane of groove 11. During such motion, each of the blades 1*a* through 1*n* punctures the wall of the bag above the article contained in the bag and each of the blades forms a short longitudinal cut in the bag wall. If the blades 1*a* through 1*n* are precisely coplanar with one another, the cuts formed by the various blades merge into a single continuous slit extending along the entire length of the bag.

In practice, however, it is difficult to maintain all of the blades in such coplanar relationship with one another. Therefore, there will be discontinuities in the slit at the junctures between the cuts made by adjacent blades. When the bag is pulled open and the article removed therefrom in a subsequent processing operation, small pieces of the bag wall may be torn from the bag at such discontinuities and deposited on the article or on the equipment utilized for removing the article. For example, if the article contained in the bag is a stack of can lids for use in food canning operations any pieces of the bag wall which become detached from the bag in this manner may contaminate the lids.

Moreover, a large number of blades and a large number of grippers must be provided if the bags to be opened are of substantial length. Such multiple components are undesirable, as they increase the cost of the apparatus and make it more difficult to maintain.

SUMMARY OF THE INVENTION

The present invention provides an apparatus for slitting bag which apparatus substantially overcomes the aforementioned disadvantages of the conventional apparatus described above.

Apparatus according to the present invention preferably includes means for supporting the bag to be opened and means for engaging a portion of the bag wall adjacent the middle of the bag. The bag wall engaging means is arranged to pull the engaged wall portion in a direction transverse to the axis of the bag so that the engaged wall portion extends in such transverse direction away from the article enclosed in the bag. The apparatus also includes two blades. Blade movement means are provided for forcing the blades through the wall of the bag between the engaged wall portion and the article enclosed in the bag to puncture the bag. The blade movement means are also operative to move the blades, after the bag has been punctured, in opposite directions away from the middle of the bag towards the ends of the bag. Thus, each of the blades make a continuous cut in the bag wall from a point adjacent the middle of the bag to a point adjacent one end of the bag.

Although there may be one discontinuity at the juncture of these two cuts, such a single discontinuity is far less objectionable than the multiple discontinuities which may be encountered with the conventional apparatus. Further, the apparatus is far simpler than the conventional apparatus described above. Only two blades need be provided, and the bag wall engaging means may include only a single gripper assembly. Thus, the apparatus of the present invention need not incorporate the great number of blades and gripper assemblies utilized in the conventional apparatus described above. Therefore, the apparatus of the present invention is relatively simple and easy to maintain.

Other features and advantages of the present invention will be more readily apparent from the detailed description of the preferred embodiments set forth below when read in conjunction with the accompanying drawings.

DETAILED DESCRIPTION OF THE PREFERRED EMBODIMENTS

Figure 1:
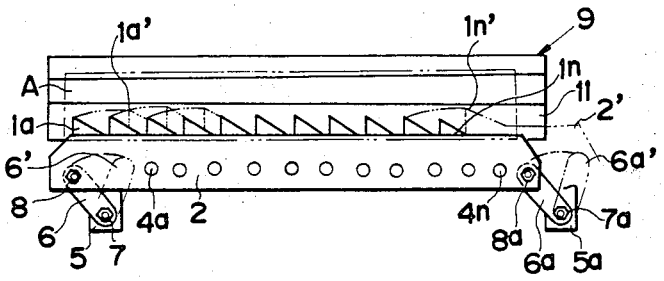
(PRIOR ART) FIG. 1
FIGS. 1 and 2 are schematic views of the essential parts of the conventional apparatus described above.
Figure 2:
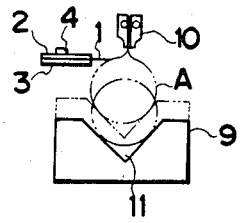
(PRIOR ART) FIG. 2
Figure 3:
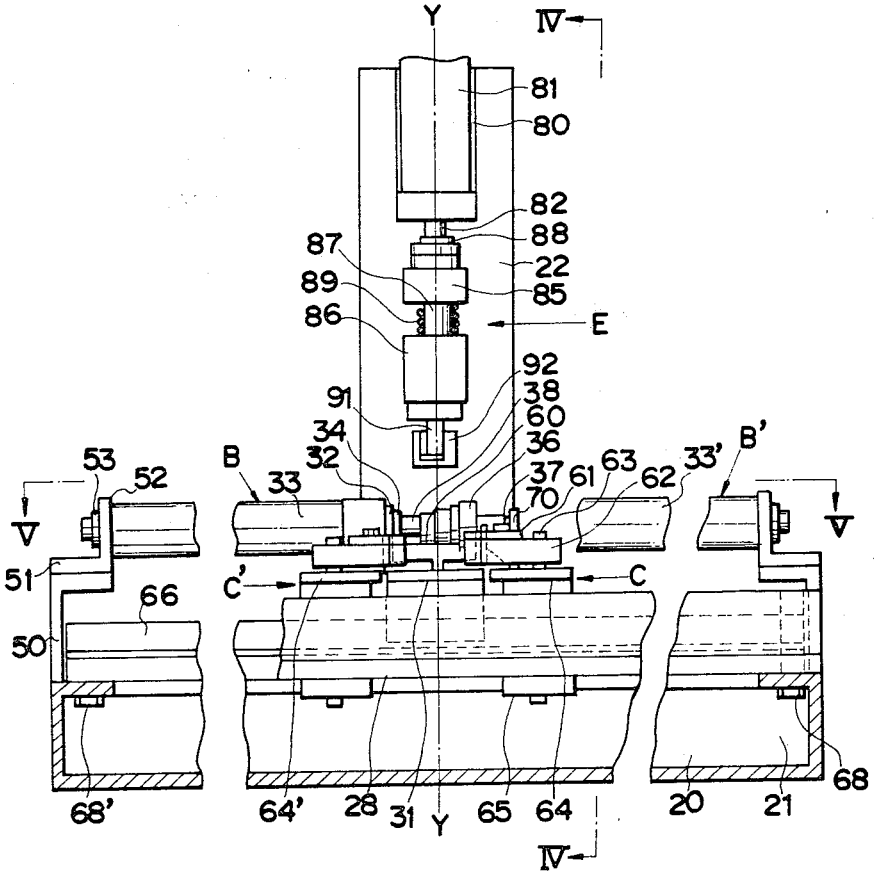
FIG. 3 is a sectional elevational view of apparatus according to an embodiment of the present invention, FIG. 3 being taken along line 3—3 in FIG. 4.
Figure 4:
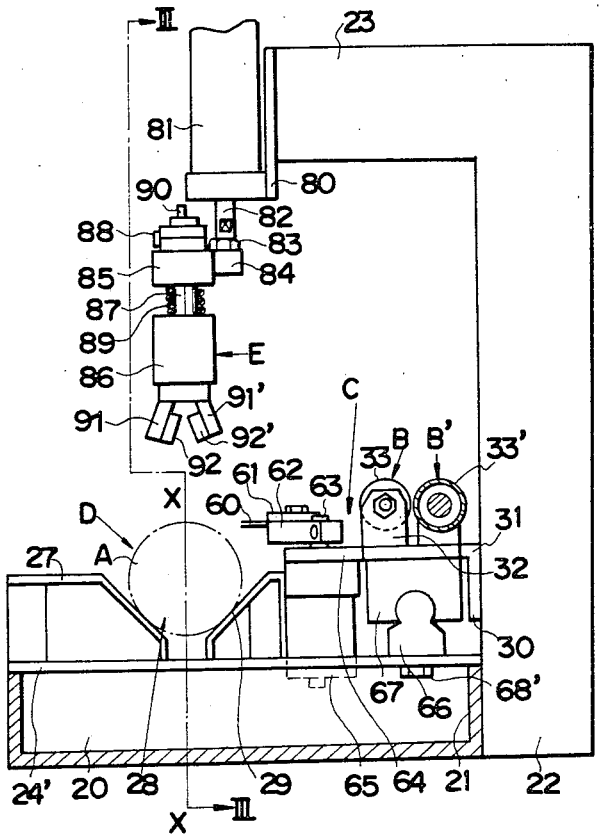
FIG. 4 is a sectional view taken along line 4—4 in FIG. 3.

As best seen in FIGS. 3 and 4, apparatus according to one embodiment of the present invention includes a frame consisting of an elongated horizontal base 20 and a vertical support column 22 fixed to a rear wall 21 of base 20. Support column 22 extends upwardly from base 20 on the rear side of the base (the side which is disposed towards the right in FIG. 4). Support column 22 is disposed adjacent the middle of base 20.

The term "middle" as used herein with reference to an elongated structure or feature should be taken as referring to the portion of such structure or feature equidistant from the ends thereof. That is, support column 22 is substantially equidistant from the ends of base as seen in FIG. 3. A groove defining structure D is provided, such structure including a front member 27 and a rear member 29. The members 27 and 29 are fixed to base 20 so that inclined surfaces of the members 27 and 29 cooperatively define an elongated horizontal groove 28 of generally V-shaped cross section, the direction of elongation of groove 28 corresponding to direction of elongation of base 20. Groove 28 is open at the top.

An elongated rail 66, seen in end view in FIG. 4 is fixed to base 20 by bolts 68 and 68′ (FIG. 3) at opposite ends of base 20. A carriage C consisting of a slide block 67 and a horizontal plate 64 fixed to slide block 67 is slidably mounted to rail 66, slide block 67 straddling the rail.

A fluid cylinder assembly B is provided for moving slide C along rail 66. The cylinder assembly B includes a cylinder 33, one end of such cylinder being fixed to base 20 by a nut 53, a bracket 51 having a vertical portion 52 and a support 50 (FIG. 3). The opposite end of cylinder 33 is fixed to column 22 by a nut 34 and a vertical support 32, vertical support 32 being fixed to a horizontal wall 31 of a bracket 30, bracket 30 being attached to column 22. A piston rod 38 is connected to a piston (not shown) received in cylinder 33. Piston rod 38 projects from the right hand end of cylinder 33 and such piston rod is connected to carriage C by way of a universal joint 36. The left hand end of universal joint 36 is connected to piston rod 38 and the opposite, right hand end of the universal joint is threadedly engaged with a vertical plate 70, plate 70 being fixedly connected to horizontal plate 64 of carriage C. A nut 37 is provided for locking the universal joint to plate 70. Appropriate devices (not shown) are provided for connecting cylinder 33 to a source of fluid under pressure and admitting such fluid to the cylinder to extend and retract piston rod 38. Cylinder assembly B can thus move carriage C along rail 66, parallel to groove 28, between the centered position illustrated in solid lines in FIG. 5 and the displaced position illustrated in broken lines. When carriage C is in its centered position, it is adjacent the middle of the base 20 and hence adjacent the middle of groove 28, carriage C in its centered position being disposed only slightly to the right of bracket 30.

Figure 5:
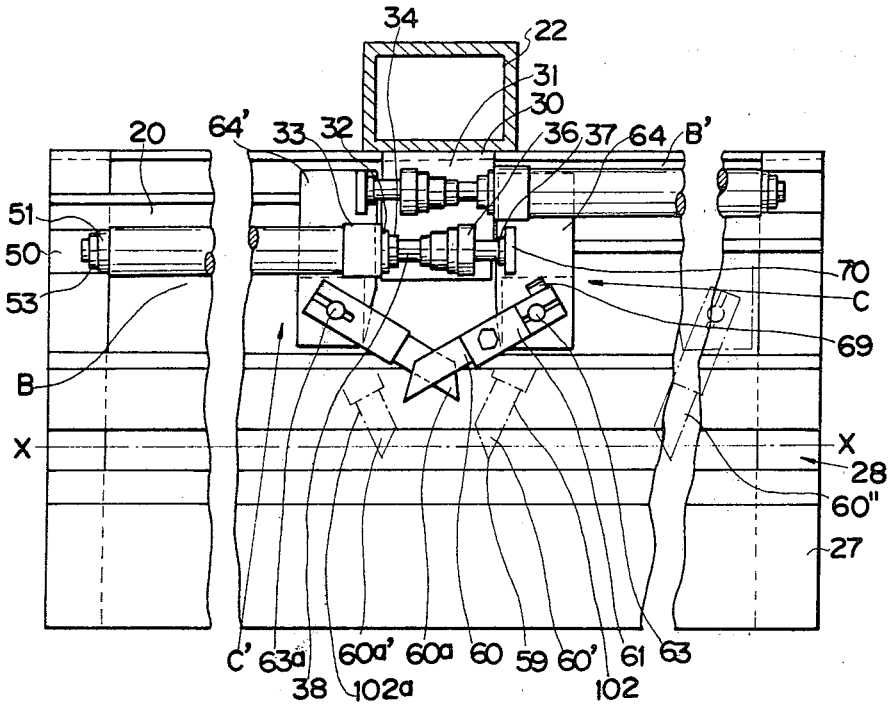
FIG. 5 is a sectional view taken along line 5—5 in FIG. 3.

When carriage C is in its displaced position, indicated in broken lines in FIG. 5, the carriage is adjacent the right hand end of the apparatus and hence adjacent the right hand end of groove 28. A second carriage C′ (FIGS. 3 and 5) is also slidably mounted to rail 66, carriage C′ being substantially similar to carriage C described above. A second cylinder assembly B′, substantially similar to the cylinder assembly B described above, is provided for moving carriage C′ between the centered position illustrated in FIG. 5 and a displaced position (not shown) in which carriage C′ is adjacent the left end of the apparatus. When carriage C′ is in its centered position, it is adjacent the middle of the apparatus but slightly to the left of bracket 30 (FIG. 5).

Two flat, pointed knife-like blades 60 and 60*a* (FIG. 5) are provided. Blade 60 is fixedly mounted between a pair of clamping plates 61 and 62, plate 62 in turn being fixedly mounted to a vertically-disposed shaft 63. Shaft 63 is mounted to horizontal plate 64 of carriage C for rotation relative thereto. Blade 60 and clamping plates 61 and 62 are disposed above horizontal plate 64. A rotary actuator 65 is mounted to the underside of plate 64 and connected to shaft 63. Actuator 65 can rotate shaft 63 about its own axis to swing blade 60 about the axis of shaft 63 between the retracted position illustrated in solid lines in FIGS. 4 and 5 and the extended position illustrated in broken lines at 60″ in FIG. 5. When blade 60 is in the retracted position, it is remote from the vertical longitudinal medial plane X—X of groove 28. When blade 60 is in the extended position 60′, the blade extends across the medial plane X—X of the groove, the tip 59 of the blade being disposed on the opposite side of such medial plane from shaft 63. Also, when the blade is in the extended position, the cutting edge 102 of the blade faces towards the right hand end of the apparatus and hence towards the displaced position of carriage C.

The other blade 60*a* is mounted to the other carriage C′ by a similar arrangement of components, blade 60*a* being swingable relative to carriage C′ about the axis of shaft 63*a*. A rotary actuator (not shown) is mounted to carriage C′ for swinging blade 60*a* between the retracted position indicated in solid lines in FIG. 5 and the extended position indicated in broken lines at 60*a*′. When blade 60*a* is in its retracted position, it is remote from the vertical longitudinal medial plane X—X of groove 28, but when blade 60*a* is in its extended position, it extends across such medial plane. Also, when blade 60*a* is in its extended position, the cutting edge 102*a* of blade 60*a* faces towards the left end of the apparatus and hence toward the displaced position of carriage C′.

Both of the blades 60 and 60*a* are disposed in horizontally extensive planes, blade 60 being disposed at a slightly higher elevation than blade 60*a*. When the apparatus is in the condition illustrated in solid lines in FIG. 5, with both carriages C and C′ in their respective centered positions, and both blades 60 and 60*a* in their respective retracted positions, the blades are in crossed relation with one another, blade 60 extending over blade 60*a*.

The apparatus also includes a bag wall engaging device E (FIGS. 3 and 4). This device includes a vertical support plate 80 fixedly mounted to arm 23 of the apparatus frame, a fluid cylinder 81 fixed to plate 80 and a piston rod 82 slidably disposed in cylinder 81 and connected to a piston (not shown) disposed in such cylinder. Cylinder 81 is generally vertically disposed, and is connected to appropriate fluid power sources (not shown) for moving piston rod 82 upwardly and downwardly. An annular bracket 85 having a lateral extension 84 is fixed to the lower end of piston rod 82 by a nut 83. A support rod 87 extends through annular bracket 85 and is slidably received therein so that rod 87 is vertically movable relative to bracket 85. A stop 88 is fixed to the upper end of rod 87 to limit downward movement of the rod relative to bracket 85. An actuator 86 is fixed to the lower end of rod 87 and a pair of opposed gripper arms 91 and 91' are connected to actuator 86 and extend downwardly therefrom, gripper arms 91 and 91' being provided with jaws 92 and 92' respectively at their respective lower ends. Actuator 86 is connected to a fluid supply line 90, and actuator 86 can be operated to swing the gripper arms 91 and 91' and the jaws 92 and 92' towards or away from one another. A tension spring 89 is connected between actuator 86 and bracket 85 so that spring 87 urges the actuator and gripper arm assembly upwardly relative to the bracket 85.

The assembly of the actuator 86, the gripper arms 91 and 91' and the jaws 92 and 92' is a commercially available product.

The gripper assembly is disposed adjacent the middle of the apparatus at the transverse medial plane Y—Y (FIG. 3) of the base and groove. Also, the jaws 92 and 92' are disposed above groove 28 on opposite sides of the longitudinal medial plane X—X (FIG. 4) of the groove.

In operation, a flexible bag A such as a bag made of paper. depicted in broken lines in FIG. 4, is placed into groove 28 so that the axis of the bag extends parallel to the axis of the trough. Ordinarily, the elongated bag A encloses an elongated article as, for example, a cylindrical stack of can lids, and the axis of the article also extends parallel to the axis of the groove when the bag is supported in the groove. Normally, there is some slack in the bag. The position of the bag along the length of groove 28 is adjusted as by pushing on one end of the bag and the article until the bag is centered within the trough, with the middle of the bag and the middle of the article being disposed adjacent the transverse medial plane Y—Y (FIG. 3) of the apparatus.

During this loading operation, the gripper assembly (the actuator 86, arms 91 and 91' and jaws 92 and 92') is retained above the groove by cylinder 81, jaws 92 and 92' being retained in an open position remote from one another by actuator 86. Also, during the loading operation, blades 60 and **60*a* (FIG. 5) are retained in their respective retracted positions remote from the longitudinal medial plane X—X of groove 28** and carriages C and C' are retained in their respective centered positions adjacent the middle of the apparatus.

Figure 6:
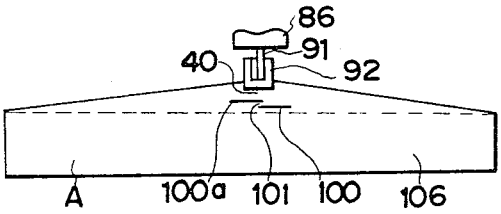
FIG. 6 is a schematic elevational view of a bag after initial penetration of such bag by the blades of the apparatus illustrated in FIGS. 3 through 5.

After the bag has been loaded into the groove, cylinder 81 is activated to lower the gripper assembly until jaws 92 and 92' bear on the top surface of the bag. Actuator 86 then swings arms 91 and 91' towards one another so that the portion of the bag wall lying between jaws 92 and 92' is pinched between the jaws and thus engaged therewith. While the jaws are retained in this closed position by actuator 86, cylinder 81 lifts the gripper assembly upwardly, thus pulling the engaged wall portion of the bag upwardly. As the article contained in the bag remains stationary within the trough, this action causes the engaged wall portion of the bag to move upwardly away from the contained article. There is a vertical clearance 40 (FIG. 6) between the gripper jaws and the top of the article 106 contained in the bag after such elevation of the gripper assembly. While the bag is engaged with the gripper jaws and the gripper assembly is retained in its elevated position, the blades 60 and **60*a* are swung simultaneously from their retracted positions to their extended position 60' and 60*a*' (FIG. 5), the carriages being retained in their respective centered positions during this swinging motion. As the blades swing towards their extended positions, they pass beneath the gripper assembly and penetrate the wall of the bag above the contained article but beneath the gripper jaws. During this initial swinging motion, the blades make two initial cuts 100 and 100*a* (FIG. 6) adjacent the middle of the bag. Once the cutters have reached their respective extended positions, the rotation of the blades relative to the carriages is stopped. The cylinder assemblies B and B' (FIG. 5) are activated to move the carriages C and C' simultaneously towards their respective displaced positions, i.e., towards the opposite ends of groove 28. Each of the blades is retained in its extended position by the associated rotary actuator during this sliding motion of the carriages. Therefore, each of the blades will make a continuous longitudinal cut in the bag wall during such sliding motion of the carriages. The cut made by each blade during sliding motion of the associated carriage will be continuous with the initial cut previously made by such blade. Therefore, the apparatus will form a continuous slit extending along the length of the bag with only one discontinuity, such discontinuity being the discontinuity 101 between the two initial cuts 100 and 100*a* (FIG. 6**).

After the bag has been slit longitudinally in this fashion, the blades are swung back to their respective retracted positions and the carriages are returned to their respective centered positions. Actuator 86 moves the gripper jaws away from one another to release the bag and the cylinder 81 (FIGS. 3 and 4) is operated to raise the gripper assembly away from the bag. The bag is then removed from the apparatus. Preferably, this is accomplished by pushing the bag and the article contained therein along trough 28 into a receiving trough (not shown) aligned therewith. The article enclosed by the bag may then be removed from the bag through the slit made by the apparatus. The bag wall must ordinarily be broken at the single discontinuity which is present in the slit. In practice, this does not cause the separation of any significant number of pieces from the bag wall and does not give rise to any significant contamination of the article contained in the bag.

Figure 7:
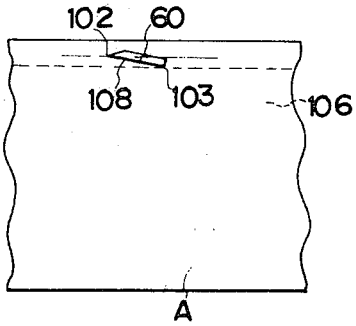
FIG. 7 is a schematic view of one of the blades of the apparatus illustrated in FIGS. 3 through 5 in conjunction with a bag and the article contained in the bag.

As illustrated in FIG. 7, blade 60 is mounted in a slightly inclined disposition. The flat lower surface 108 of blade 60 slopes slightly upwardly from its rear edge 103 to the cutting edge 102 of the blade. Blade **60*a* has a similar inclined disposition. This inclined disposition of the blades is especially useful if the article 106 contained in the bag A has an irregular profile. For example, if the article 106** is a stack of disc like can lids, and the lids are not precisely aligned with one another, edge portions of some lids will protrude from the stack. The inclined disposition of the blades will enable the blades to pass over protruding lids and thus prevent damage to the blades.

Figure 8:
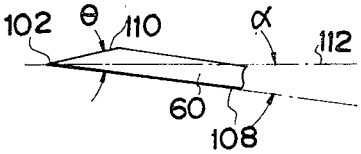
FIG. 8 is a schematic view of a blade of the apparatus illustrated in FIGS. 3 through 5.

As best seen in FIG. 8, the cutting edge 102 of blade 60 is defined by the lower surface 108 of the blade and an upper surface 110 which angularly intersects lower surface 108. If such a blade configuration is utilized, the lower surface 108 of the blade is preferably disposed at an angle $\alpha$ to the horizontal plane 112, such angle being approximately one half of the included angle $\theta$ defined by surfaces 108 and 110 at cutting edge 102. This relationship between blade disposition and cutting edge geometry is believed to contribute to effective cutting action. Of course, the other blade 60*a* (FIG. 5) has a similar disposition and geometry.

As will be readily appreciated, numerous variations and combinations of the features described above can be utilized without departing from the present invention as described in the claims. Therefore, the foregoing description should be understood by way of illustration rather than by way of limitation of the present invention.

What is claimed is:

1. Apparatus for opening an elongated bag enclosing an article, said apparatus comprising:

(a) bag support means including structure defining an elongated, horizontally extensive groove open at the top to dispose a portion of the wall of a supported bag thereabove;

(b) means for engaging such portion of the bag wall adjacent the middle of the bag and pulling the engaged wall portion in a direction transverse to the longitudinal axis of the bag so that the engaged wall portion extends in such transverse direction away from the article enclosed in the bag;

(c) two blades; and (d) blade movement means for forcing said blades through the wall of the bag adjacent the engaged wall portion thereof to puncture the bag and then moving said blades in opposite directions towards the ends of the bag to slit the wall of the bag, said blade movement means including a pair of carriages connected to said structure for movement relative thereto in direction generally parallel to said groove an disposed on the same side of said groove, means for moving each such carriage between a centered position in which such carriage is adjacent the middle of the groove and a displaced position in which such carriage is adjacent an end of said groove, said displaced positions being adjacent respective opposite ends of said groove, each of said blades being movably mounted to one of said carriages and disposed above said groove, and blade extension means for moving each of said blades relative to the associated one of said carriages between a retracted position in which such blade is remote from the vertical longitudinal medial plane of said groove and an extended position in which such blade is adjacent such medial plane, said blades being generally flat and disposed in horizontally extensive planes, each of said blades being pivotally mounted to the associated one of said carriages for movement relative thereto about a generally vertical blade pivot axis, said blade extension means being operative to swing each of said blades about the associated blade pivot axis.

2. Apparatus as claimed in claim 1 in which said blades are in crossed relation to one another with one of said blades overlying the other one of said blades when both of said carriages are in their respective centered positions and both of said blades are in their respective retracted positions.

3. Apparatus as claimed in claim 1 in which said carriage movement means is operative to retain each of said carriages in its centered position during movement of the associated blade from its retracted position to its extended position.

4. Apparatus as claimed in claim 3 in which said said blade extension means is operative to retain each of said blades in its extended position during motion of the associated carriage from its centered position to its displaced position.

5. Apparatus as claimed in claim 4 in which said blade extension means is operative to move both of said blades simultaneously from their respective retracted positions to their respective extended positions.

6. Apparatus as claimed in claim 5 in which said carriage movement means is operative to move both of said carriages simultaneously from their respective centered positions towards their respective displaced positions.

7. Apparatus as claimed in claim 1 in which the cutting edge of each of said blades faces towards the displaced position of the associated carriage when such blade is in its extended position.

8. Apparatus as claimed in claim 7 in which the lower face of each of said blades slopes upwardly towards the cutting edge of such blade.

9. Apparatus as claimed in claim 8 in which the cutting edge of each of said blades is defined by the lower face of such blade and an upper face of such blade intersecting such lower face, the angle between the lower face of each such blade and a horizontal plane being approximately one half of the angle included between such intersecting faces of such blade.

10. Apparatus for opening an elongated bag enclosing an article, said apparatus comprising:

(a) bag support means including structure defining an elongated, horizontally extensive groove open at the top to dispose a portion of the wall of a supported bag thereabove;

(b) means for engaging such portion of the bag wall and pulling the engaged wall portion in a direction transverse to the longitudinal axis of the bag so that the engaged wall portion extends in such transverse direction away from the article enclosed in the bag;

(c) blade means for bag punching and cutting; and (d) blade movement means supporting said blade means for rotative movement about a generally vertically disposed axis for initially forcing said blade means through the wall of the bag adjacent the engaged wall portion thereof to puncture the bag and for then moving said blade means in respective opposite directions longitudinally of the bag to slit the wall of the bag.

11. Apparatus as claimed in claim 10 in which said bag engaging means includes a gripper assembly disposed above said groove adjacent the middle thereof, means for operating said gripper assembly to engage the bag wall and means for elevating said gripper assembly while said gripper is engaged with the bag wall.

12. Apparatus as claimed in claim 11 in which said gripper assembly includes a pair of opposed jaws.

* * * * *